US011214065B2

(12) United States Patent
Cumbie et al.

(10) Patent No.: US 11,214,065 B2
(45) Date of Patent: Jan. 4, 2022

(54) FLUID EJECTION DIE INTERLOCKED WITH MOLDED BODY

(71) Applicant: HEWLETT-PACKARD DEVELOPMENT COMPANY, L.P., Spring, TX (US)

(72) Inventors: Michael W Cumbie, Corvallis, OR (US); Chien-Hua Chen, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/629,142

(22) PCT Filed: Jul. 28, 2017

(86) PCT No.: PCT/US2017/044447
§ 371 (c)(1),
(2) Date: Jan. 7, 2020

(87) PCT Pub. No.: WO2019/022773
PCT Pub. Date: Jan. 31, 2019

(65) Prior Publication Data
US 2020/0223226 A1 Jul. 16, 2020

(51) Int. Cl.
*B41J 2/16* (2006.01)
*B41J 2/14* (2006.01)

(52) U.S. Cl.
CPC ..... *B41J 2/1637* (2013.01); *B41J 2/1404* (2013.01); *B41J 2/14024* (2013.01); *B41J 2/1433* (2013.01); *B41J 2/162* (2013.01); *B41J 2202/11* (2013.01)

(58) Field of Classification Search
CPC .... B41J 2/1637; B41J 2/14024; B41J 2/1404; B41J 2/1433; B41J 2202/11; B41J 2/162; B41J 2/1603
See application file for complete search history.

(56) References Cited

U.S. PATENT DOCUMENTS

| | | | |
|---|---|---|---|
| 5,637,166 A | 6/1997 | Swanson et al. | |
| 6,347,861 B1 | 2/2002 | Tom et al. | |
| 7,182,434 B2 | 2/2007 | Silverbrook et al. | |
| 8,342,652 B2 | 1/2013 | Nystrom et al. | |
| 9,724,920 B2 * | 8/2017 | Chen | B41J 2/1632 |

(Continued)

FOREIGN PATENT DOCUMENTS

| | | |
|---|---|---|
| JP | 61125853 | 6/1986 |
| JP | 61125856 | 6/1986 |

(Continued)

OTHER PUBLICATIONS

Brandenburg, S.D. Overmolded Electronic Assembly Packaging, Aug. 2, 2004 < http://electroiq.com/blog/2004/07/overmolded-electronic-assembly-packaging/ >.

*Primary Examiner* — Geoffrey S Mruk
(74) *Attorney, Agent, or Firm* — Dicke Billig & Czaja PLLC

(57) ABSTRACT

A fluid ejection device includes a fluid ejection die including a substrate and a fluid architecture supported by the substrate, and a molded body molded around the fluid ejection die, with the molded body interlocked with the fluid architecture of the fluid ejection die.

14 Claims, 10 Drawing Sheets

(56) References Cited

U.S. PATENT DOCUMENTS

| | | | |
|---|---|---|---|
| 2005/0093174 | A1 | 5/2005 | Seng |
| 2005/0127534 | A1 | 6/2005 | Stecher |
| 2007/0111399 | A1 | 5/2007 | Goida |
| 2008/0073757 | A1 | 3/2008 | Kummerl et al. |
| 2010/0079542 | A1 | 4/2010 | Ciminelli et al. |
| 2014/0264955 | A1 | 9/2014 | Feyh et al. |
| 2016/0001551 | A1 | 1/2016 | Chen |
| 2016/0009082 | A1 | 1/2016 | Chen et al. |
| 2017/0028723 | A1 | 2/2017 | Lutnesky et al. |
| 2017/0165973 | A1 | 6/2017 | Lesier et al. |

FOREIGN PATENT DOCUMENTS

| | | | |
|---|---|---|---|
| JP | S-61125852 | | 6/1986 |
| JP | 04144751 | | 5/1992 |
| JP | 08300687 | | 11/1996 |
| JP | 2002096473 | | 4/2002 |
| JP | 2013501655 | | 1/2013 |
| JP | 2016508460 | | 3/2016 |
| TW | 201639714 | A | 11/2016 |
| WO | WO-2011019529 | | 2/2011 |
| WO | WO-2012105935 | | 8/2012 |
| WO | WO-2014133516 | | 9/2014 |
| WO | WO-2016032497 | | 3/2016 |

* cited by examiner

FLUID EJECTION DIE INTERLOCKED WITH MOLDED BODY

BACKGROUND

A fluid ejection die, such as a printhead die in an inkjet printing system, may use thermal resistors or piezoelectric material membranes as actuators within fluidic chambers to eject fluid drops (e.g., ink) from nozzles, such that properly sequenced ejection of ink drops from the nozzles causes characters or other images to be printed on a print medium as the printhead die and the print medium move relative to each other.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure.

Figure 1:
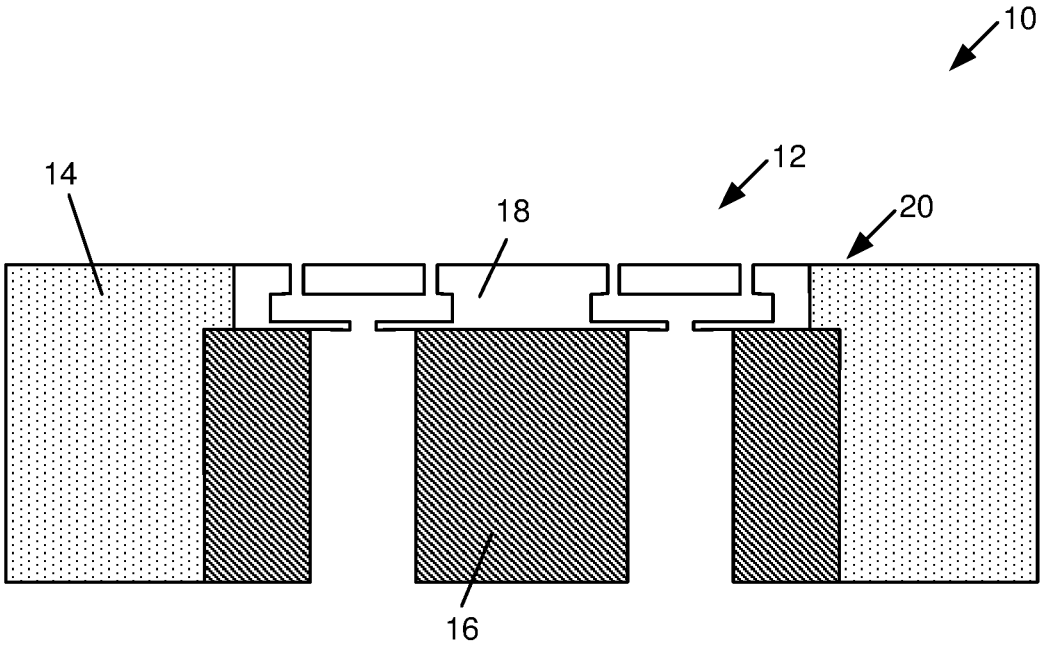
FIG. 1 is a schematic cross-sectional view illustrating an example of a fluid ejection device.

As illustrated in the example of FIG. 1, the present disclosure provides a fluid ejection device 10. In one implementation, the fluid ejection device includes a fluid ejection die 12 and a molded body 14 molded around the fluid ejection die, with the fluid ejection die including a substrate 16 and a fluid architecture 18 supported by the substrate, and the molded body interlocked with the fluid architecture of the fluid ejection die, for example, by interlock 20.

Figure 2:
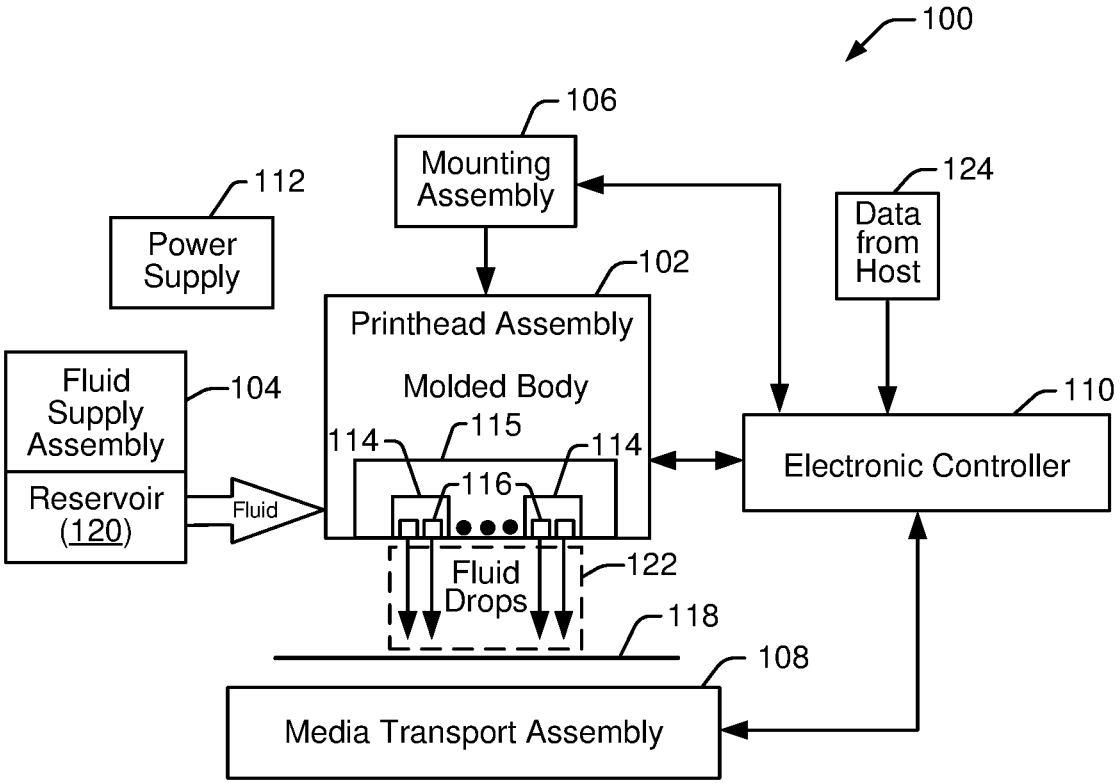
FIG. 2 is a block diagram illustrating an example of an inkjet printing system including an example of a fluid ejection device.

FIG. 2 illustrates an example of an inkjet printing system including an example of a fluid ejection device, as disclosed herein. Inkjet printing system 100 includes a printhead assembly 102, as an example of a fluid ejection assembly, a fluid (ink) supply assembly 104, a mounting assembly 106, a media transport assembly 108, an electronic controller 110, and at least one power supply 112 that provides power to the various electrical components of inkjet printing system 100. Printhead assembly 102 includes at least one printhead die

114, as an example of a fluid ejection die, that ejects drops of fluid (ink) through a plurality of orifices or nozzles 116 toward a print medium 118 so as to print on print media 118. In one implementation, one (i.e., a single) printhead die 114 or more than one (i.e., multiple) printhead die 114, as an example of a fluid ejection die, is molded into a molded body 115.

Print media 118 can be any type of suitable sheet or roll material, such as paper, card stock, transparencies, Mylar, and the like, and may include rigid or semi-rigid material, such as cardboard or other panels. Nozzles 116 are typically arranged in one or more columns or arrays such that properly sequenced ejection of fluid (ink) from nozzles 116 causes characters, symbols, and/or other graphics or images to be printed on print media 118 as printhead assembly 102 and print media 118 are moved relative to each other.

Fluid (ink) supply assembly 104 supplies fluid (ink) to printhead assembly 102 and, in one example, includes a reservoir 120 for storing fluid such that fluid flows from reservoir 120 to printhead assembly 102. Fluid (ink) supply assembly 104 and printhead assembly 102 can form a one-way fluid delivery system or a recirculating fluid delivery system. In a one-way fluid delivery system, substantially all of the fluid supplied to printhead assembly 102 is consumed during printing. In a recirculating fluid delivery system, only a portion of the fluid supplied to printhead assembly 102 is consumed during printing. Fluid not consumed during printing is returned to fluid (ink) supply assembly 104.

In one example, printhead assembly 102 and fluid (ink) supply assembly 104 are housed together in an inkjet cartridge or pen. In another example, fluid (ink) supply assembly 104 is separate from printhead assembly 102 and supplies fluid (ink) to printhead assembly 102 through an interface connection, such as a supply tube. In either example, reservoir 120 of fluid (ink) supply assembly 104 may be removed, replaced, and/or refilled. Where printhead assembly 102 and fluid (ink) supply assembly 104 are housed together in an inkjet cartridge, reservoir 120 includes a local reservoir located within the cartridge as well as a larger reservoir located separately from the cartridge. The separate, larger reservoir serves to refill the local reservoir. Accordingly, the separate, larger reservoir and/or the local reservoir may be removed, replaced, and/or refilled.

Mounting assembly 106 positions printhead assembly 102 relative to media transport assembly 108, and media transport assembly 108 positions print media 118 relative to printhead assembly 102. Thus, a print zone 122 is defined adjacent to nozzles 116 in an area between printhead assembly 102 and print media 118. In one example, printhead assembly 102 is a scanning type printhead assembly. As such, mounting assembly 106 includes a carriage for moving printhead assembly 102 relative to media transport assembly 108 to scan print media 118. In another example, printhead assembly 102 is a non-scanning type printhead assembly. As such, mounting assembly 106 fixes printhead assembly 102 at a prescribed position relative to media transport assembly 108. Thus, media transport assembly 108 positions print media 118 relative to printhead assembly 102.

Electronic controller 110 typically includes a processor, firmware, software, one or more memory components including volatile and non-volatile memory components, and other printer electronics for communicating with and controlling printhead assembly 102, mounting assembly 106, and media transport assembly 108. Electronic controller 110 receives data 124 from a host system, such as a computer, and temporarily stores data 124 in a memory.

Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one example, electronic controller 110 controls printhead assembly 102 for ejection of fluid (ink) drops from nozzles 116. Thus, electronic controller 110 defines a pattern of ejected fluid (ink) drops which form characters, symbols, and/or other graphics or images on print media 118. The pattern of ejected fluid (ink) drops is determined by the print job commands and/or command parameters.

Printhead assembly 102 includes one (i.e., a single) printhead die 114 or more than one (i.e., multiple) printhead die 114. In one example, printhead assembly 102 is a wide-array or multi-head printhead assembly. In one implementation of a wide-array assembly, printhead assembly 102 includes a carrier that carries a plurality of printhead dies 114, provides electrical communication between printhead dies 114 and electronic controller 110, and provides fluidic communication between printhead dies 114 and fluid (ink) supply assembly 104.

In one example, inkjet printing system 100 is a drop-on-demand thermal inkjet printing system wherein printhead assembly 102 includes a thermal inkjet (TIJ) printhead that implements a thermal resistor as a drop ejecting element to vaporize fluid (ink) in a fluid chamber and create bubbles that force fluid (ink) drops out of nozzles 116. In another example, inkjet printing system 100 is a drop-on-demand piezoelectric inkjet printing system wherein printhead assembly 102 includes a piezoelectric inkjet (PIJ) printhead that implements a piezoelectric actuator as a drop ejecting element to generate pressure pulses that force fluid (ink) drops out of nozzles 116.

Figure 3:
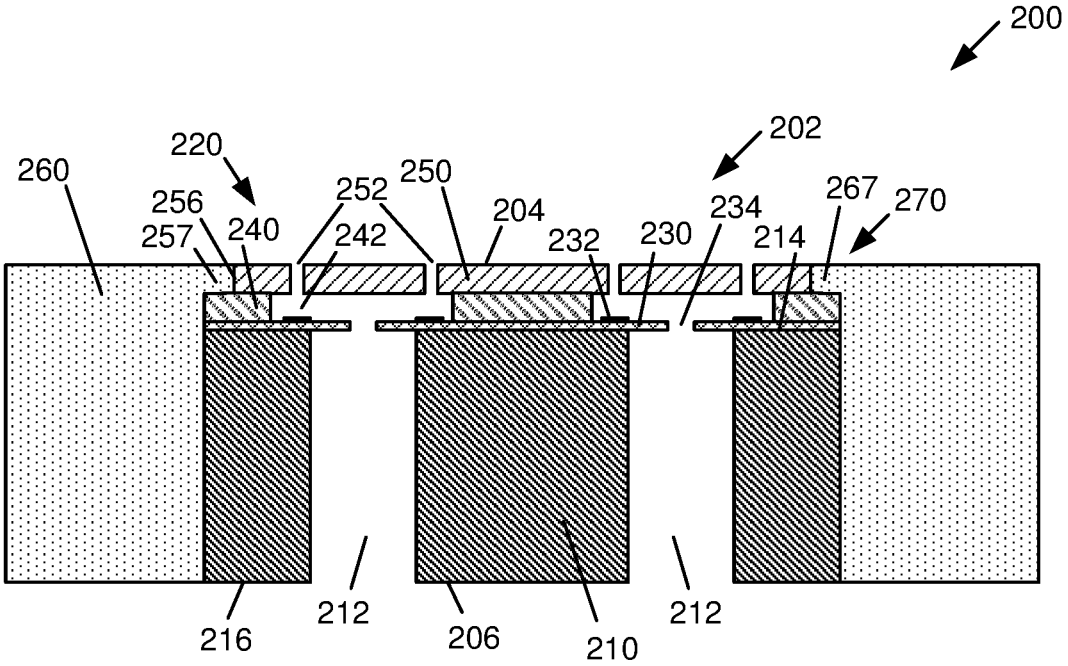
FIG. 3 is a schematic cross-sectional view illustrating an example of a fluid ejection device.

FIG. 3 is a schematic cross-sectional view illustrating an example of a fluid ejection device 200. In one implementation, fluid ejection device 200 includes a fluid ejection die 202 molded into a molded body 260, as described below.

Fluid ejection die 202 includes a substrate 210 and a fluid architecture 220 supported by substrate 210. In the illustrated example, substrate 210 has two fluid (or ink) feed slots 212 formed therein. Fluid feed slots 212 provide a supply of fluid (such as ink) to fluid architecture 220 such that fluid architecture 220 facilitates the ejection of fluid (or ink) drops from fluid ejection die 202. While two fluid feed slots 212 are illustrated, a greater or lesser number of fluid feed slots may be used in different implementations.

Substrate 210 has a first or front-side surface 214 and a second or back-side surface 216 opposite front-side surface 214 such that fluid flows through fluid feed slots 212 and, therefore, through substrate 210 from the back side to the front side. Accordingly, in one implementation, fluid feed slots 212 communicate fluid (or ink) with fluid architecture 220 through substrate 210.

In one example, substrate 210 is formed of silicon and, in some implementations, may comprise a crystalline substrate such as doped or non-doped monocrystalline silicon or doped or non-doped polycrystalline silicon. Other examples of suitable substrates include gallium arsenide, gallium phosphide, indium phosphide, glass, silica, ceramics, or a semiconducting material.

As illustrated in the example of FIG. 3, fluid architecture 220 is formed on or provided on front-side surface 214 of substrate 210. In one implementation, fluid architecture 220 includes a thin-film structure 230 formed on or provided on front-side surface 214 of substrate 210, a barrier layer 240 formed on or provided on thin-film structure 230, and an orifice layer 250 formed on or provided on barrier layer 240. As such, orifice layer 250 (with orifices 252 therein) provides a first or front-side surface 204 of fluid ejection die 202, and substrate 210 (with fluid feed slots 212 therein) provides a second or back-side surface 206 of fluid ejection die 202.

In one example, thin-film structure 230 includes one or more than one passivation or insulation layer formed, for example, of silicon dioxide, silicon carbide, silicon nitride, tantalum, poly-silicon glass, or other material, and a conductive layer which defines drop ejecting elements 232 and corresponding conductive paths and leads. The conductive layer is formed, for example, of aluminum, gold, tantalum, tantalum-aluminum, or other metal or metal alloy. In one example, thin-film structure 230 has one or more than one fluid (or ink) feed hole 234 formed therethrough which communicates with fluid feed slot 212 of substrate 210.

Examples of drop ejecting elements 232 include thermal resistors or piezoelectric actuators, as described above. A variety of other devices, however, can also be used to implement drop ejecting elements 232 including, for example, a mechanical/impact driven membrane, an electrostatic (MEMS) membrane, a voice coil, a magnetostrictive drive, and others.

In one example, barrier layer 240 defines a plurality of fluid ejection chambers 242 each containing a respective drop ejecting element 232 and communicated with fluid feed hole 234 of thin-film structure 230. Barrier layer 240 includes one or more than one layer of material and may be formed, for example, of a photoimageable epoxy resin, such as SU8.

In one example, orifice layer 250 is formed or extended over barrier layer 240 and has nozzle openings or orifices 252, as examples of fluid ejection orifices, formed therein. Orifices 252 communicate with respective fluid ejection chambers 242 such that drops of fluid are ejected through respective orifices 252 by respective drop ejecting elements 232.

Orifice layer 250 includes one or more than one layer of material and may be formed, for example, of a photoimageable epoxy resin, such as SU8, or a nickel substrate. In some implementations, orifice layer 250 and barrier layer 240 are the same material and, in some implementations, orifice layer 250 and barrier layer 240 may be integral.

As illustrated in the example of FIG. 3, molded body 260 is interlocked with ejection die 202. More specifically, and as further described herein, molded body 260 is interlocked with fluid architecture 220 of fluid ejection die 202. As such, fluid ejection die 202 is constrained by and locked into or with molded body 260. In one example, molded body 260 is interlocked with fluid ejection die 202 by an interlock 270. Interlock 270 includes mating or corresponding interconnected, engaged or meshed structures, elements, features or aspects of molded body 260 and fluid ejection die 202, including, more specifically, fluid architecture 220 of fluid ejection die 202.

In one example, as illustrated in FIG. 3, molded body 260 is interlocked with fluid ejection die 202 by interlock 270 at orifice layer 250 of fluid architecture 220, with barrier layer 240 supported by substrate 210 and orifice layer 250 supported by barrier layer 240. More specifically, in one implementation, interlock 270 includes a recessed feature 257 at an edge 256 of orifice layer 250 and a corresponding precipice, protrusion or protruded portion 267 of molded body 260 extended into or formed in the space of recessed feature 257. As such, molded body 260 is interconnected, engaged or meshed with fluid ejection die 202.

Figure 4A:
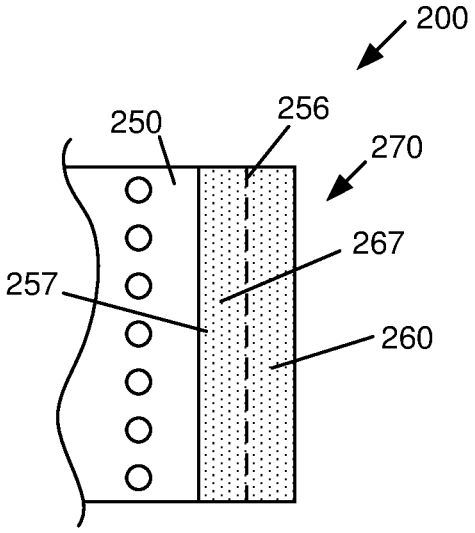
FIG. 4A is a schematic plan view illustrating an example of a portion of the fluid ejection device of FIG. 3.

FIG. 4A is a schematic plan view (top view) illustrating an example of a portion of fluid ejection device 200 including interlock 270. In the illustrated example, recessed feature 257 extends along the full length of edge 256 of orifice layer 250. As such, corresponding protruded portion 267 of molded body 260 extends along the full length of edge 256 of orifice layer 250.

Figure 4B:
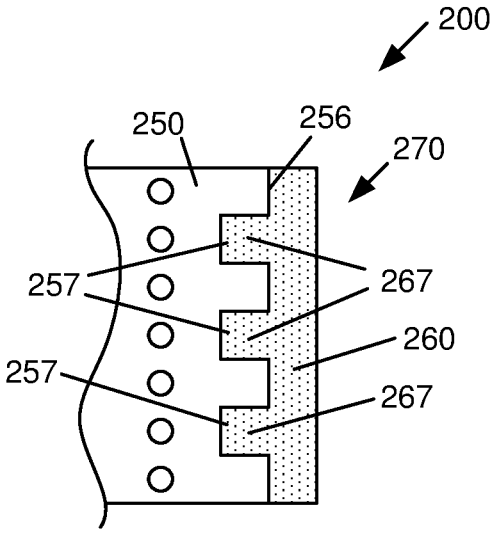
FIG. 4B is a schematic plan view illustrating another example of a portion of the fluid ejection device of FIG. 3.

FIG. 4B is a schematic plan view (top view) illustrating another example of a portion of fluid ejection device 200 including interlock 270. In the illustrated example, recessed feature 257 includes a plurality of recessed features 257 spaced along edge 256 of orifice layer 250. As such, corresponding protruded portion 267 of molded body 260 includes a plurality of protruded portions 267 spaced along edge 256 of orifice layer 250.

Although illustrated as having a square-notch profile, recessed features 257 may have other profiles, including, for example, a V-notch profile, a U-shaped profile, or a radiused profile. In addition, recessed features 257 may be of different shapes or sizes, and may have other arrangements or configurations.

Figure 5:
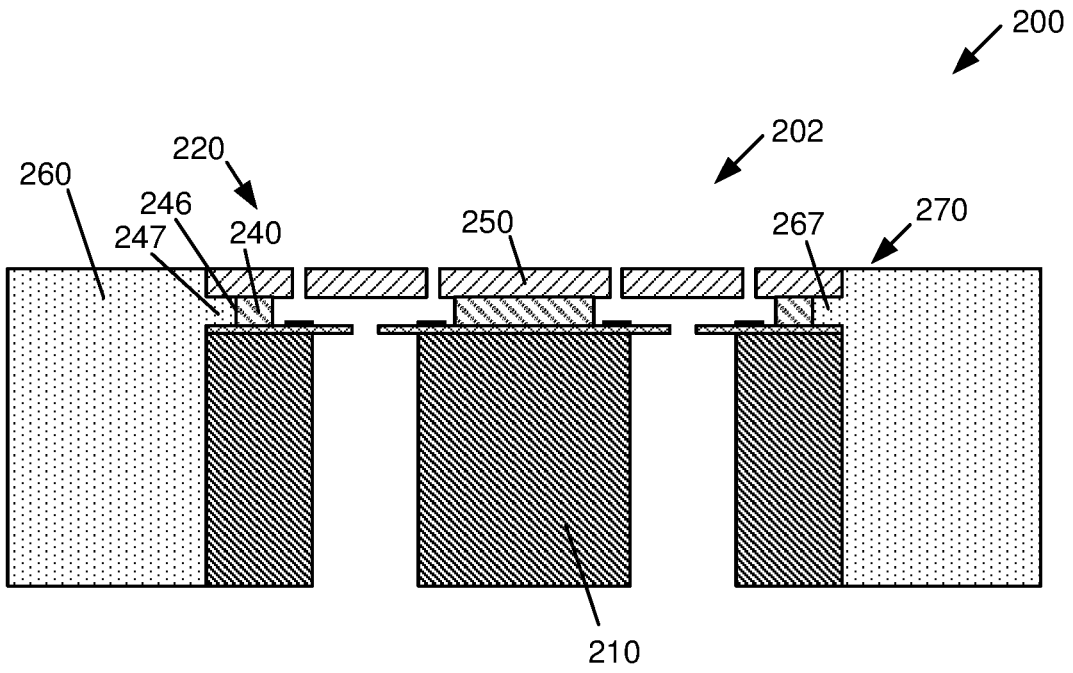
FIG. 5 is a schematic cross-sectional view illustrating another example of a fluid ejection device.

In one example, as illustrated in FIG. 5, molded body 260 is interlocked with fluid ejection die 202 by interlock 270 at barrier layer 240 of fluid architecture 220, with barrier layer 240 supported by substrate 210 and orifice layer 250 supported by barrier layer 240. More specifically, in one implementation, interlock 270 includes a recessed feature 247 at an edge 246 of barrier layer 240 and a corresponding precipice, protrusion or protruded portion 267 of molded body 260 extended into or formed in the space of recessed feature 247. As such, molded body 260 is interconnected, engaged or meshed with fluid ejection die 202.

Similar to recessed feature 257, as illustrated in the examples of FIGS. 4A and 4B, recessed feature 247 may extend along a full length of edge 246 of barrier layer 240 or may include a plurality of recessed features 247 spaced along edge 246 of barrier layer 240. As such, corresponding protruded portion 267 of molded body 260 may extend along the full length of edge 246 of barrier layer 240 or may include a plurality of protruded portions 267 spaced along edge 246 of barrier layer 240.

Figure 6:
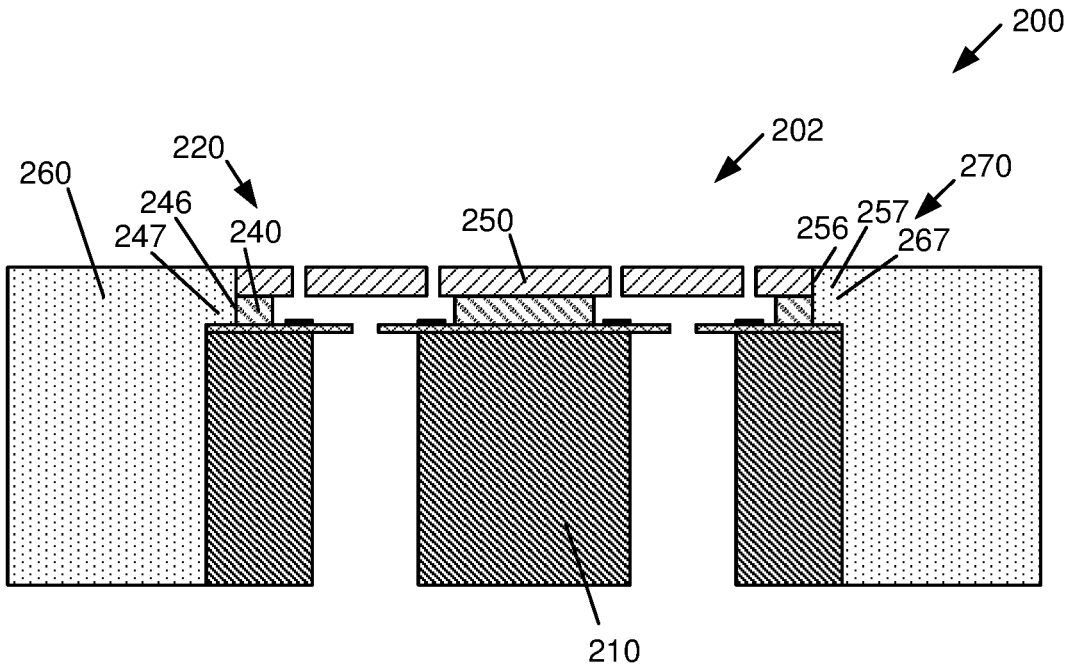
FIG. 6 is a schematic cross-sectional view illustrating another example of a fluid ejection device.

In one example, as illustrated in FIG. 6, molded body 260 is interlocked with fluid ejection die 202 at orifice layer 250 and barrier layer 240 of fluid architecture 220, with barrier layer 240 supported by substrate 210 and orifice layer 250 supported by barrier layer 240. More specifically, in one implementation, interlock 270 includes recessed feature 257 at edge 256 of orifice layer 250 and recessed feature 247 at edge 246 of barrier layer 240, and a corresponding precipice, protrusion or protruded portion 267 of molded body 260 extended into or formed in the space of recessed feature 257 of orifice layer 250 and recessed feature 247 of barrier layer 240. As such, molded body 260 is interconnected, engaged or meshed with fluid ejection die 202.

Similar to that illustrated in the examples of FIGS. 4A and 4B, recessed feature 257 and recessed feature 247 of FIG. 6 may extend along a full length of edge 256 of orifice layer 250 or may include a plurality of recessed features 257 spaced along edge 256 of orifice layer 250 and may extend along a full length of edge 246 of barrier layer 240 or may include a plurality of recessed features 247 spaced along edge 246 of barrier layer 240, respectively. As such, corresponding protruded portion 267 of molded body 260 of FIG. 6 may extend along the full length of edge 256 of orifice layer 250 or may include a plurality of protruded portions 267 spaced along edge 256 of orifice layer 250 and may extend along the full length of edge 246 of barrier layer 240 or may include a plurality of protruded portions 267 spaced along edge 246 of barrier layer 240.

Figure 7:
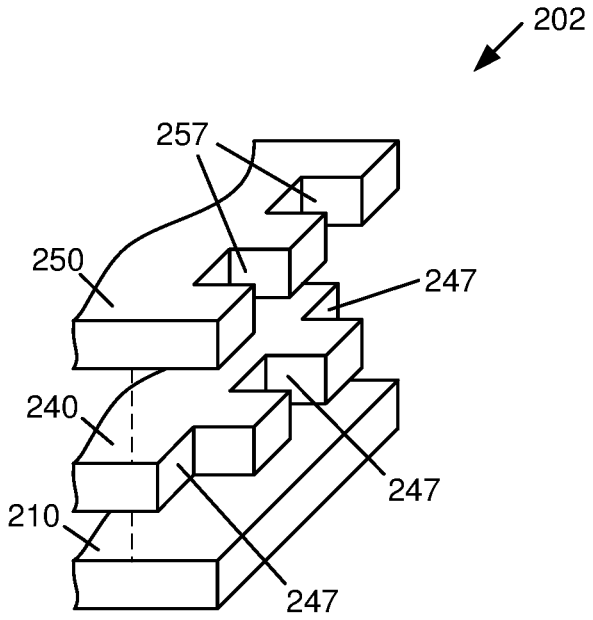
FIG. 7 is an exploded schematic perspective view illustrating an example of a portion of a fluid ejection device.

In one example, as illustrated in FIG. 7, recessed features 257 and 247 of respective orifice layer 250 and barrier layer 240, as supported by substrate 210, are staggered or offset relative to each other. As such, corresponding precipice, protrusion or protruded portions of molded body 260 (not illustrated in FIG. 7), as extended into or formed in the space of recessed features 257 and 247 of respective orifice layer 250 and barrier layer 240, are staggered or offset. As such, molded body 260 is interconnected, engaged or meshed with fluid eject ejection die 202.

Figure 8A:
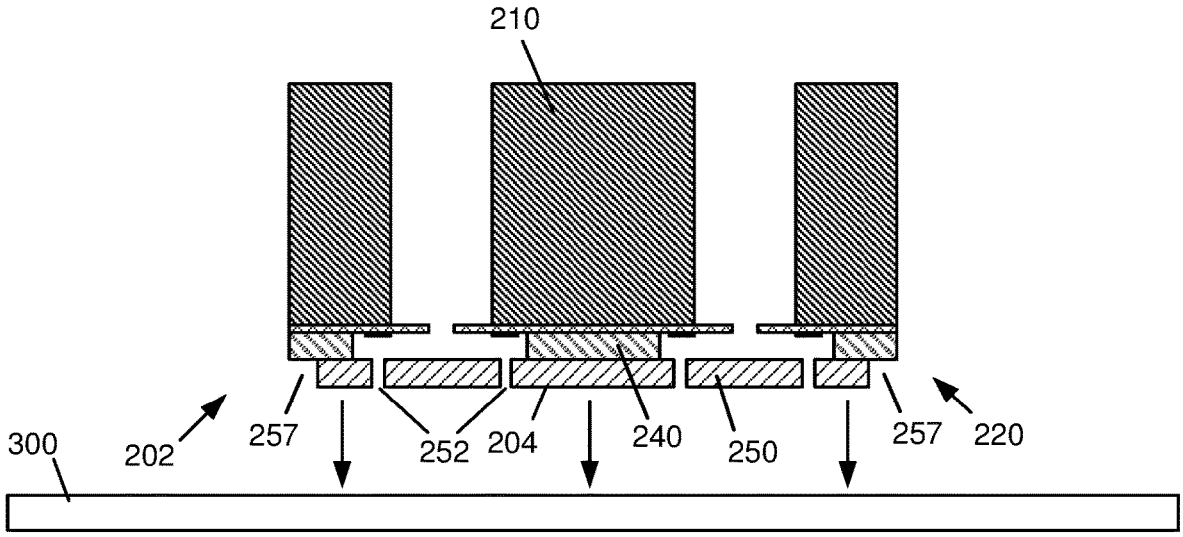
FIGS. 8A, 8B, 8C, 8D schematically illustrate an example of forming a fluid ejection device.

FIGS. 8A, 8B, 8C, 8D schematically illustrate an example of forming fluid ejection device 200. In one example, as illustrated in FIG. 8A, fluid ejection die 202 (with fluid architecture 220 provided on substrate 210) is positioned on a die carrier 300. More specifically, fluid ejection die 202 is positioned on die carrier 300 with front-side surface 204 facing die carrier 300, as indicated by the direction arrows. As such, orifices 252 face die carrier 300, with orifice layer 250 including, for example, recessed feature 257 (and/or barrier layer 240 including recessed feature 247). In one implementation, a thermal release tape (not shown) is provided on a surface of die carrier 300 before fluid ejection die 202 is positioned on die carrier 300.

Figure 8B:
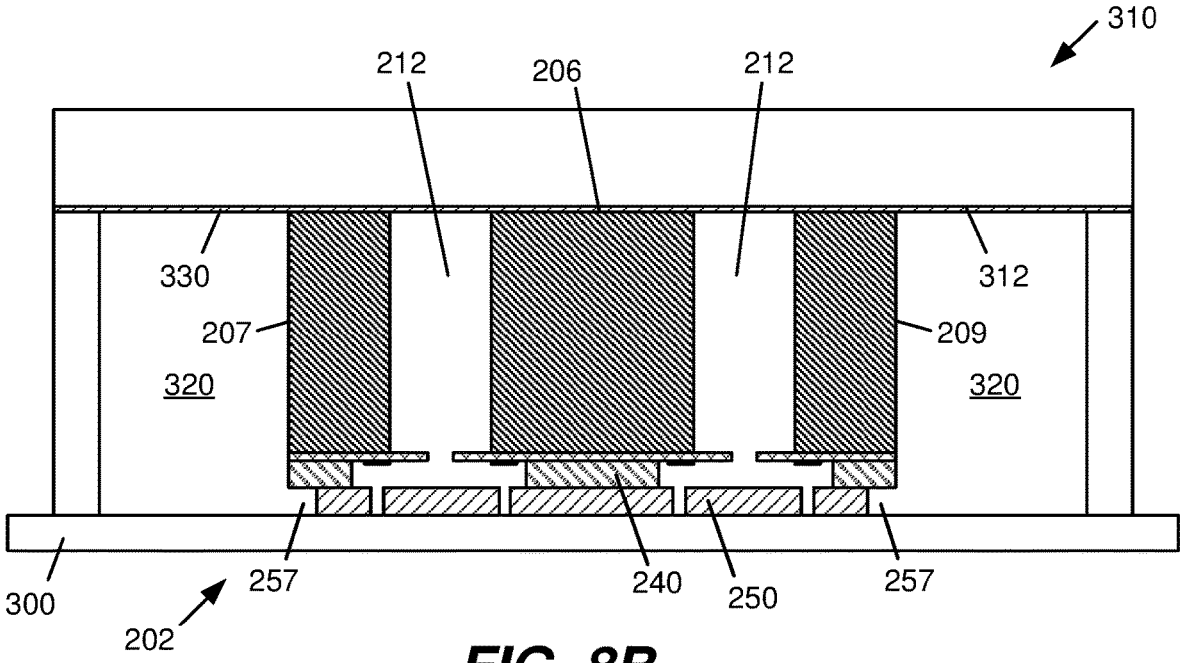

As illustrated in the example of FIG. 8B, with fluid ejection die 202 positioned on die carrier 300, an upper mold chase 310 is positioned over fluid ejection die 202 (and die carrier 300). More specifically, upper mold chase 310 is positioned over fluid ejection die 202 with back-side surface 206 of fluid ejection die 202 facing upper mold chase 310. As such, upper mold chase 310 seals fluid feed slots 212 (as formed in substrate 210 and communicated with back-side surface 206) to protect fluid feed slots 212 during molding of molded body 260. In one implementation, upper mold chase 310 includes a substantially planar surface 312 which extends over fluid feed slots 212 and beyond opposite edges (for example, edges 207 and 209) of fluid ejection die 202 to seal fluid feed slots 212 and create cavities 320 between upper mold chase 310 and die carrier 300 around and along opposite edges (for example, edges 207 and 209) of fluid ejection die 202, with cavities 320 including and extending into, for example, recessed feature 257 of orifice layer 250 (and/or recessed feature 247 of barrier layer 240).

In one example, a release liner 330 is positioned along surface 312 of upper mold chase 310 so as to be positioned between fluid ejection die 202 and upper mold chase 310. Release liner 330 helps to prevent contamination of upper mold chase 310 and minimize flash during the molding process.

Figure 8C:
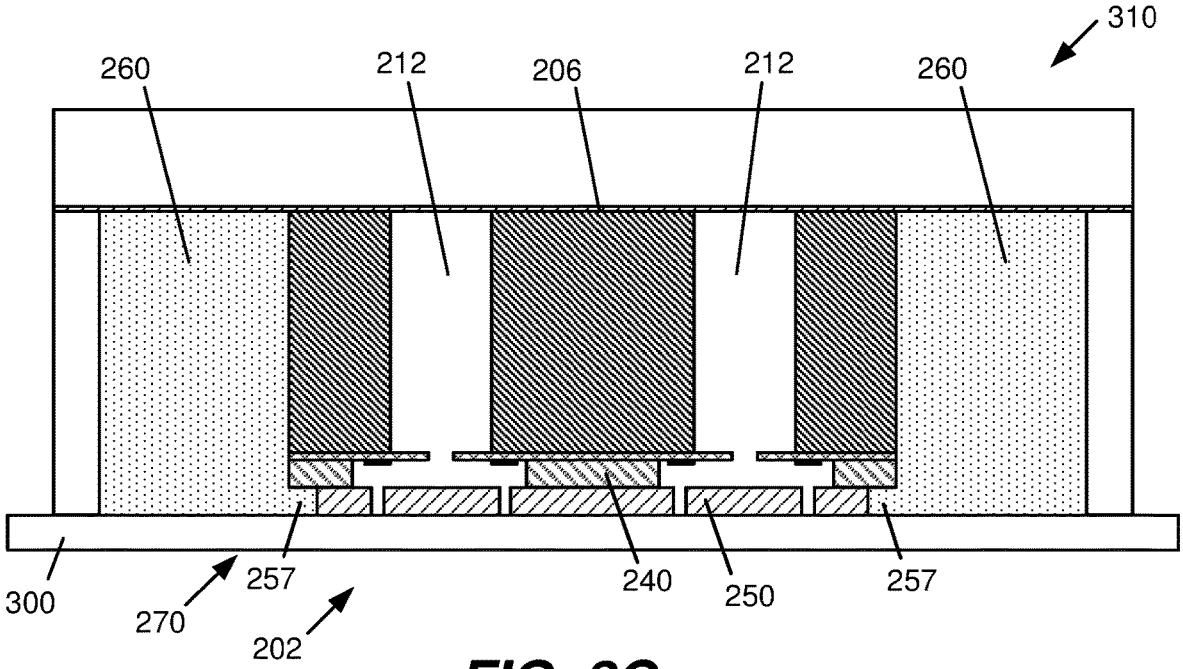

As illustrated in the example of FIG. 8C, cavities 320, including, for example, recessed feature 257 of orifice layer 250 (and/or recessed feature 247 of barrier layer 240) are filled with mold material, such as an epoxy mold compound, plastic, or other suitable moldable material. Filling cavities 320 with mold material forms molded body 260, with interlock 270, around fluid ejection die 202. In one example, the molding process is a transfer molding process and includes heating the mold material to a liquid form and injecting or vacuum feeding the liquid mold material into cavities 320 (for example, through runners communicated with cavities 320). As such, upper mold chase 310 (as positioned along back-side surface 206 of fluid ejection die 202) helps to prevent the mold material from entering fluid feed slots 212 as cavities 320 are filled.

Figure 8D:
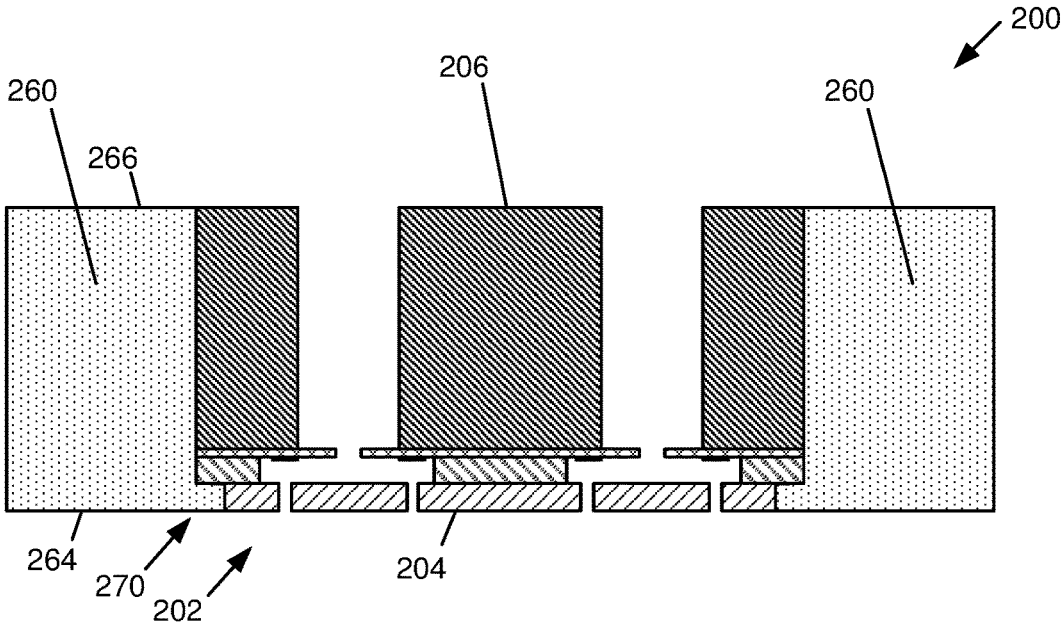

In one example, as illustrated in FIG. 8D, after the mold material cools and hardens to a solid, upper mold chase 310 and die carrier 300 are separated, and fluid ejection die 202, as molded into and interlocked with molded body 260 by interlock 270, is removed or released from die carrier 300. Thus, molded body 260 is molded to include molded surface 264 and molded surface 266, with molded surface 264 substantially coplanar with front-side surface 204 of fluid ejection die 202 and molded surface 266 substantially coplanar with back-side surface 206 of fluid ejection die 202.

Figure 9:
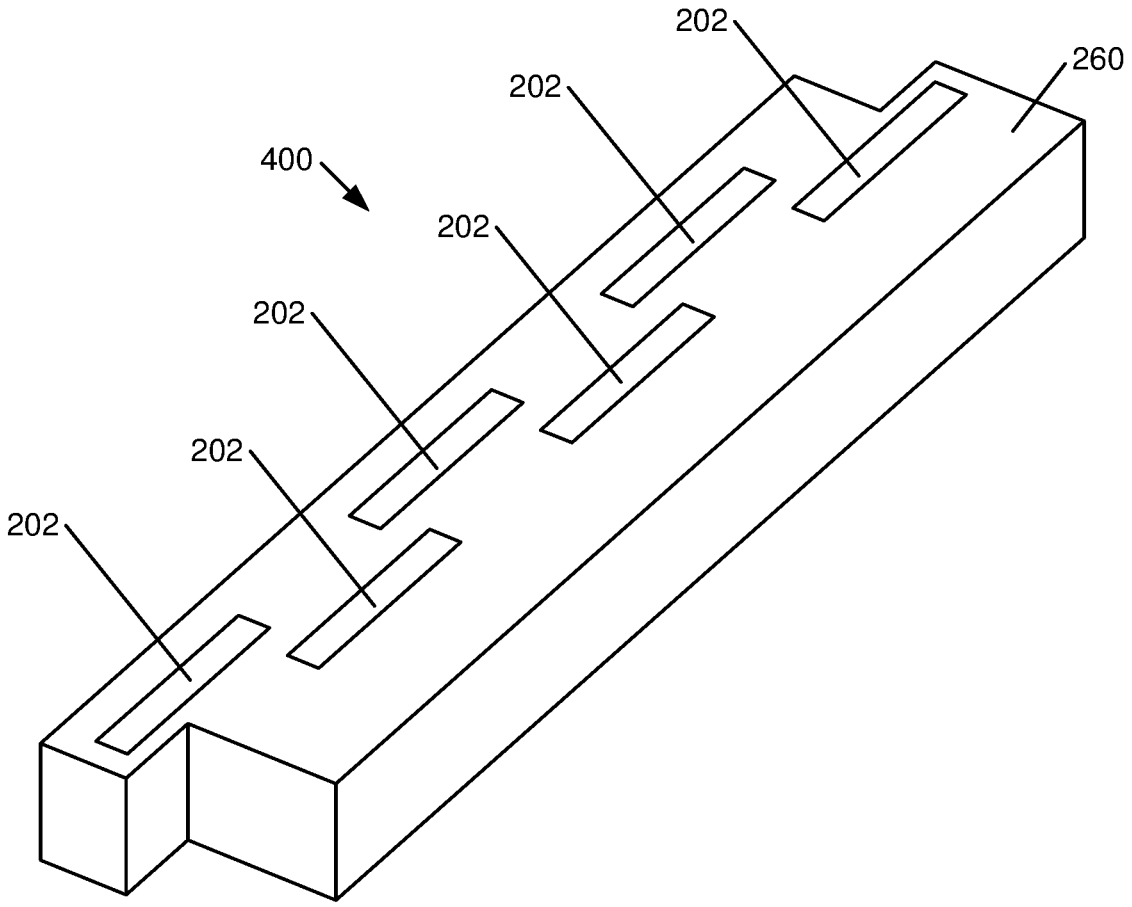
FIG. 9 is a schematic perspective view illustrating an example of a fluid ejection device including multiple fluid ejection dies.

While one fluid ejection die 202 is illustrated in FIGS. 8A, 8B, 8C, 8D as being molded into and interlocked with molded body 260, a greater number of fluid ejection dies 202 may be molded into and interlocked with molded body 260. For example, as illustrated in FIG. 9, six fluid ejection dies 202 are molded into and interlocked with molded body 260 to form a fluid ejection device 400 as a monolithic molded body with multiple fluid ejection dies 202. In one implementation, fluid ejection device 400 is a wide-array or multi-head printhead assembly with fluid ejection dies 202 arranged and aligned in one or more overlapping rows such that fluid ejection dies 202 in one row overlap at least one fluid ejection die 202 in another row. As such, fluid ejection device 400 may span a nominal page width or a width shorter or longer than a nominal page width. For example, the printhead assembly may span 8.5 inches of a Letter size print medium or a distance greater than or less than 8.5 inches of the Letter size print medium. While six fluid ejection dies 202 are illustrated as being molded into and interlocked with molded body 260, the number of fluid ejection dies 202 molded into and interlocked with molded body 260 may vary.

Figure 10:
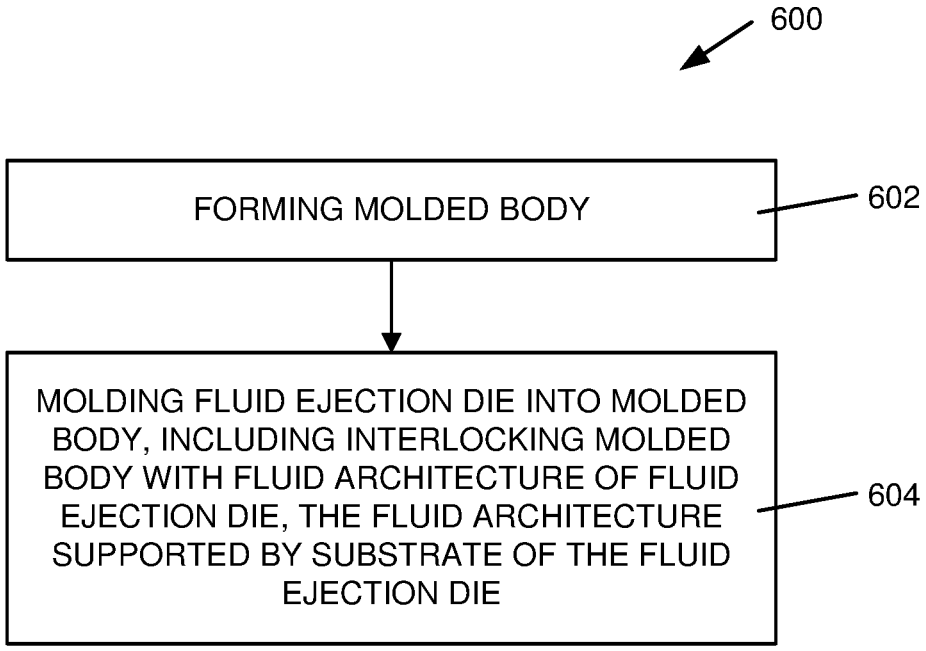
FIG. 10 is a flow diagram illustrating an example of a method of forming a fluid ejection device.

FIG. 10 is a flow diagram illustrating an example of a method 600 of forming a fluid ejection device, such as fluid ejection device 200, 400 as illustrated in the examples of FIGS. 3, 4A, 4B, 5, 6, 7, 8A-8D, 9. At 602, method 600 includes forming a molded body, such as molded body 260. And, at 604, method 600 includes molding a fluid ejection die into the molded body and interlocking the molded body with the fluid ejection die, such as fluid ejection die(s) 202 molded into and interlocked with molded body 260.

In one example, molding a fluid ejection die into the molded body and interlocking the molded body with the fluid ejection die, at 604, includes interlocking the molded body with a fluid architecture of the fluid ejection die, with the fluid architecture being supported by a substrate of the fluid ejection die, such as interlocking molded body 260 with fluid architecture 220 of fluid ejection die 202, whereby fluid architecture 220 is supported by substrate 210. In one implementation, interlocking the molded body with the fluid architecture includes interlocking the molded body with the fluid architecture at the barrier layer, with the barrier layer recessed relative to the orifice layer, such as interlocking molded body 260 with fluid architecture 220 at barrier layer 240, whereby barrier layer 240 is recessed relative to orifice layer 250 at, for example, recessed feature 247. In another implementation, interlocking the molded body with the fluid architecture includes interlocking the molded body with the fluid architecture at the orifice layer, with the orifice layer recessed relative to the barrier layer, such as interlocking molded body 260 with fluid architecture 220 at orifice layer 250, whereby orifice layer 250 is recessed relative to barrier layer 240 at, for example, recessed feature 257.

As disclosed herein, fluid ejection die are molded into and interlocked with a molded body, such as fluid ejection die 202 molded into and interlocked with molded body 260. Molding fluid ejection die into a molded body and interlocking the fluid ejection die with the molded body, as disclosed herein, helps to constrain the fluid ejection die.

Example fluid ejection devices, as described herein, may be implemented in printing devices, such as two-dimensional printers and/or three-dimensional printers (3D). As will be appreciated, some example fluid ejection devices may be printheads. In some examples, a fluid ejection device may be implemented into a printing device and may be utilized to print content onto a media, such as paper, a layer of powder-based build material, reactive devices (such as lab-on-a-chip devices), etc. Example fluid ejection devices include ink-based ejection devices, digital titration devices, 3D printing devices, pharmaceutical dispensation devices, lab-on-chip devices, fluidic diagnostic circuits, and/or other such devices in which amounts of fluids may be dispensed/ejected.

Although specific examples have been illustrated and described herein, it will be appreciated by those of ordinary skill in the art that a variety of alternate and/or equivalent implementations may be substituted for the specific examples shown and described without departing from the scope of the present disclosure. This application is intended to cover any adaptations or variations of the specific examples discussed herein.

The invention claimed is:

1. A fluid ejection device, comprising:

a fluid ejection die including a substrate and a fluid architecture supported by the substrate; and a molded body molded around the fluid ejection die, the molded body interlocked with the fluid architecture of the fluid ejection die, the fluid architecture including a barrier layer supported by the substrate and an orifice layer supported by the barrier layer, at least one of the barrier layer and the orifice layer having a recessed feature relative to the other of the barrier layer and the orifice layer, and the molded body interlocked with the fluid architecture at the recessed feature.

2. The fluid ejection device of claim 1, the barrier layer including a plurality of fluid ejection chambers, and the orifice layer including a plurality of fluid ejection orifices communicated with the fluid ejection chambers.

3. The fluid ejection device of claim 1, the barrier layer having the recessed feature relative to the orifice layer, and the molded body interlocked with the fluid architecture at the barrier layer.

4. The fluid ejection device of claim 1, the orifice layer having the recessed feature relative to the barrier layer, and the molded body interlocked with the fluid architecture at the orifice layer.

5. The fluid ejection device of claim 1, the barrier layer having the recessed feature relative to the orifice layer, the orifice layer having the recessed feature relative to the barrier layer, and the molded body interlocked with the fluid architecture at the barrier layer and the orifice layer.

6. A fluid ejection device, comprising:

a molded body; and a fluid ejection die molded into the molded body, the fluid ejection die including a substrate and a fluid architecture supported by the substrate, the fluid architecture including a barrier layer supported by the substrate and an orifice layer supported by the barrier layer, at least one of the barrier layer and the orifice layer having a recessed feature at an edge thereof relative to the other of the barrier layer and the orifice layer, and the molded body extended into the recessed feature.

7. The fluid ejection device of claim 6, the recessed feature formed in the barrier layer relative to the orifice layer, and the molded body extended into the recessed feature at the barrier layer.

8. The fluid ejection device of claim 6, the recessed feature formed in the orifice layer relative to the barrier layer, and the molded body extended into the recessed feature at the orifice layer.

9. The fluid ejection device of claim 6, the recessed feature formed in the barrier layer relative to the orifice layer and formed in the orifice layer relative to the barrier layer, and the molded body extended into the recessed feature at the barrier layer and the orifice layer.

10. The fluid ejection device of claim 6, the recessed feature including a plurality of spaced recessed features, and the molded body extended into the plurality of spaced recessed features.

11. A method of forming a fluid ejection device, comprising:

forming a molded body; and molding a fluid ejection die into the molded body, including interlocking the molded body with a fluid architecture of the fluid ejection die, the fluid architecture including a barrier layer supported by a substrate and an orifice layer supported by the barrier layer, and at least one of the barrier layer and the orifice layer having a recessed feature relative to the other of the barrier layer and the orifice layer, wherein interlocking the molded body with the fluid architecture includes interlocking the molded body with the recessed feature.

12. The method of claim 11, the barrier layer including a plurality of fluid ejection chambers, and the orifice layer including a plurality of fluid ejection orifices communicated with the fluid ejection chambers.

13. The method of claim 11, wherein interlocking the molded body with the fluid architecture includes interlocking the molded body with the fluid architecture at the barrier layer, the barrier layer having the recessed feature relative to the orifice layer.

14. The method of claim 11, wherein interlocking the molded body with the fluid architecture includes interlocking the molded body with the fluid architecture at the orifice layer, the orifice layer having the recessed feature relative to the barrier layer.

* * * * *